US011728075B2

(12) United States Patent
Contera Antoranz et al.

(10) Patent No.: US 11,728,075 B2
(45) Date of Patent: Aug. 15, 2023

(54) MAGNETIC MICRO-PARTICLES

(71) Applicant: Oxford University Innovation Limited, Oxford (GB)

(72) Inventors: Sonia Contera Antoranz, Oxford (GB); Ileana Andrea Bonilla Brunner, Oxford (GB)

(73) Assignee: OXFORD UNIVERSITY INNOVATION LIMITED, Oxford (GB)

( * ) Notice: Subject to any disclaimer, the term of this patent is extended or adjusted under 35 U.S.C. 154(b) by 972 days.

(21) Appl. No.: 16/335,424

(22) PCT Filed: Sep. 22, 2017

(86) PCT No.: PCT/GB2017/052852
§ 371 (c)(1),
(2) Date: Mar. 21, 2019

(87) PCT Pub. No.: WO2018/055405
PCT Pub. Date: Mar. 29, 2018

(65) Prior Publication Data

US 2020/0020469 A1 Jan. 16, 2020

(30) Foreign Application Priority Data

Sep. 23, 2016 (GB) ..... 1616191

(51) Int. Cl.

| | |
|---|---|
| ***H01F 1/00*** | (2006.01) |
| ***H01F 1/113*** | (2006.01) |
| ***H01F 1/26*** | (2006.01) |
| ***H01F 1/37*** | (2006.01) |

(52) U.S. Cl.
CPC ..... *H01F 1/113* (2013.01); *H01F 1/0018* (2013.01)

(58) Field of Classification Search
CPC ..... H01F 1/0018; H01F 1/0081; H01F 1/113; H01F 1/26; H01F 1/37; B22F 1/0547; B22F 1/16
USPC ..... 252/62.54
See application file for complete search history.

(56) References Cited

U.S. PATENT DOCUMENTS 4,368,131 A * 1/1983 Rosenweig ..... B01J 8/42 428/404
2016/0145600 A1* 5/2016 Caracci ..... H01F 1/26 435/402
2016/0172085 A1* 6/2016 Arnold ..... C22C 32/00 75/228

FOREIGN PATENT DOCUMENTS

WO 2009/143444 A1 11/2009

OTHER PUBLICATIONS

International Search Report & Written Opinion for WO2018/055405 (PCT/GB2017/052852), dated Dec. 7, 2017, pp. 1-11.
International Preliminary Report on Patentability for WO2018/055405 (PCT/GB2017/052852), dated Mar. 26, 2019, pp. 1-8.
UK Search Report for GB1616191.1, dated Jan. 26, 2017, pp. 1-5.
Ding et al: "Micelle-assisted synthesis of polyaniline/magnetite nanorods by in situ self-assembly process", Journal of Colloid and Interface Science, vol. 320, No. 1, Jan 10, 2008, pp. 341-345.
(Continued)

*Primary Examiner* — Matthew E. Hoban
*Assistant Examiner* — Lynne Edmondson
(74) *Attorney, Agent, or Firm* — Thomas|Horstemeyer, LLP

(57) ABSTRACT

A magnetic micro-particle (201) comprising one or more magnetic nano-wires (202).

13 Claims, 4 Drawing Sheets

(56) References Cited

OTHER PUBLICATIONS

Omar et al: "Highly Efficient Thermoresponsive Nanocomposite for Controlled Release Applications", Scientific Reports, vol. 6, No. 1, Jun. 23, 2016.
Lipeng et al: "Design and synthesis of magnetic nanoparticles augmented microcapsule with catalytic and magnetic bifunctionalities for dye removal", Chemical Engineering Journal, vol. 197, May 5, 2012, pp. 350-358.
Naveed et al: "Modified double emulsion process as a new route to prepare submicron biodegradable magnetic/polycaprolactone particles for in vivo theranostics", Soft Matter, vol. 8, No. 8, Jan. 1, 2012, p. 2554.
Zavisova et al: "Synthesis and Characterisation of Rod-Like Magnetic Nanoparticles", Jan. 1, 2010, p. 14.
Xiongjun et al: "A biodegradable shape-memory nanocomposite with excellent magnetism sensitivity", Nanotechnology, vol. 20, No. 23, Jun. 10, 2009, p. 235702.
Bender et al: "Synthesis and characterization of uniaxial ferrogels with Ni nanorods as magnetic phase", Journal of Magnetism and Magnetic Materials, vol. 323, No. 15, Mar. 12, 2011, pp. 2055-2063.
Scientific Reports, 6, (2016), Yassine O. et al., "Highly efficient thermoresponsive nanocomposite for controlled release applications", pp. 1-7.
Chemical Engineering Journal, 197, pp. 350-358, (2012), Kong L. et al., "Design and synthesis of magnetic nanoparticles augmented microcapsule with catalytic and magnetic bifunctionalities for dye removal", pp. 1-9.
IEEE transactions on magnetics 43(6), pp. 2929-2931 (2007), Clime L. et al., "Dynamics of superparamagnetic and ferromagnetic nano-objects in continuous-flow microfluidic devices", pp. 1-3.
Soft Matter 8(8), pp. 2554-2564. (2012) Ahmed N. et al., "Modified double emulsion process as a new route to prepare submicron biodegradable agnetic/polycaprolactone particles for in vivo theranostics", pp. 1-11.
Balmayor et al., "Synthesis and functionalization of caprolactone microparticles for the selective isolation of subpopulations of human adipose-derived stem cells", Journal of The Royal Society Interface, 2011, 896-908.
Dyab et al., "Fabrication of novel anisotropic magnetic microparticles", Journal of Materials Chemistry, 2009, 3475-3481.
Karatą et al, "Poly(ε-caprolactone) microparticles containing levobunolol HCI prepared by a multiple emulsion (W/O/N) solvent evaporation technique: Effects of some formulation parameters on microparticle characteristics", Journal of Microencapsulation, 2048, Apr. 2016.

* cited by examiner

MAGNETIC MICRO-PARTICLES

CROSS-REFERENCE TO RELATED APPLICATIONS

This application is the National Stage of International Application No. PCT/GB2017/052852, filed Sep. 22, 2017, which claims the priority to GB 1616191.1, filed Sep. 23, 2016, which are entirely incorporated herein by reference.

This invention relates to magnetic micro-particles and their method of manufacture.

Magnetic micro-particles, e.g. containing magnetic nano-particles, are used to manipulate small volumes of fluid and other material in a variety of ways and for a variety of uses. For example, there are a number of chemical and biomedical uses in which magnetic micro-particles can be used (under the influence of an applied magnetic field) for micro-mixing of liquids, in flow cytometry, for single cell studies, as magnetic tweezers, etc.

Magnetic micro-particles may be made using a micro-emulsion, e.g. of an oil containing magnetic nano-particles in water, or by printing micro-particles from a polymer solution containing magnetic nano-particles. In each case the initial solution used to form the micro-particles is then polymerised and/or cross-linked to solidify the micro-particles.

The aim of invention is to provide an improved magnetic micro-particle and a method for manufacturing such magnetic micro-particles.

When viewed from a first aspect the invention provides a magnetic micro-particle comprising one or more magnetic nano-wires.

It will thus be seen that the present invention provides a micro-particle (e.g. on the micron scale) containing one or more magnetic nano-wires (e.g. on the nanometre scale). The magnetic nano-wire in the micro-particle therefore creates a magnetic micro-particle. It will be appreciated that owing to the length of the nano-wires this creates a magnetic dipole, e.g. such that when a (e.g. oscillating) magnetic field is applied to the micro-particle this allows a relatively large torque to be exerted on the micro-particle. This may be used, when a magnetic field is applied, to rotate the magnetic micro-particles or, e.g., a fluid containing magnetic micro-particles.

This contrasts to conventional magnetic micro-particles containing (e.g. spherical) nano-particles which are essentially located at a single point and thus have no length over which to form a meaningful magnetic dipole. Such conventional magnetic micro-particles have non-homogeneous magnetic properties which are difficult to control, particularly for rotating. The presence of one or more nano-wires in the micro-particles of the present invention therefore allows the micro-particles of the present invention to be controlled more easily and to be moved, e.g. rotated, more quickly than micro-particles that simply contain magnetic nano-particles.

In preferred embodiments of the present invention the Applicant has observed that magnetic micro-particles containing nano-wires can rotate suspended in a fluid at speeds up to 20 times faster than known micro-particles containing magnetic nano-particles. Thus the rotation in an applied (e.g. oscillating) magnetic field of magnetic micro-particles of the present invention that contain nano-wires is enhanced owing to the enhanced magnetic dipole behaviour of the magnetic nano-wires compared to magnetic nano-particles.

The micro-particle may have any suitable and desired shape. In one embodiment the micro-particle is substantially spherical. In a preferred embodiment the micro-particle is substantially an ellipsoid, e.g. a spheroid. This helps to increase the overall magnetic dipole of the magnetic micro-particle (e.g. for an ellipsoid micro-particle compared with a spherical micro-particle) and thus the torque that is generated to manipulate the micro-particle in a (e.g. oscillating) magnetic field. As will be appreciated, a micro-particle that has an ellipsoid shape has an enhanced magnetic dipole, which will naturally align its major axis with the magnetic field, and thus the rotation of the micro-particle in an applied magnetic field is particularly enhanced owing to the increased torque generated by the ellipsoid shaped micro-particle.

Preferably the micro-particle is substantially a prolate spheroid. The (e.g. prolate) spheroid preferably has an eccentricity, $$\varepsilon = \sqrt{\frac{a^2 - b^2}{a^2}}$$

(where a and b are the respective lengths of the major and minor axes of the spheroid, assuming that the two equatorial axes of the spheroid are of approximately equal length), between 0.3 and 1.0, e.g. between 0.5 and 0.8, e.g. approximately 0.65.

The micro-particle may be made from any suitable and desired material. In a preferred embodiment the micro-particle comprises a polymer. The polymer may be any suitable and desired type of polymer, e.g. polycaprolactone (PCL). Preferably the polymer is cross-linked, e.g. cross-linked polycaprolactone. (Cross-linking is the process of connecting already polymerised chains of monomers.) Preferably the micro-particle (e.g. the material it comprises) is biocompatible and/or biodegradable (N.B. PCL is both biocompatible and biodegradable).

The material of the micro-particle may be in any suitable and desired state. The micro-particle may comprise a liquid, a solid or a gel. Preferably the material of the micro-particle (e.g. a solid or gel) is arranged such that the (positions of the) one or more nano-wires are held fixed (immobilised) in the micro-particle. Preferably this is achieved by the micro-particle comprising a solid cross-linked polymer.

The micro-particle may have any suitable and desired dimensions. In a preferred embodiment its maximum dimension, e.g. its diameter when spherical or its major axis when an ellipsoid, is between 1 μm and 1 mm, e.g. between 10 μm and 300 μm, e.g. between 50 μm and 100 μm.

The micro-particle may comprise any suitable and desired number of nano-wires. Preferably the micro-particle comprises a plurality of nano-wires.

The one or more nano-wires may be arranged in the micro-particle in any suitable and desired way. Preferably the one or more nano-wires are suspended (e.g. immobilised) within the micro-particle. When there are a plurality of nano-wires in the micro-particle, preferably the nano-wires are arranged homogeneously throughout the micro-particle.

In one embodiment, when the micro-particle comprises a plurality of nano-wires, the plurality of nano-wires are clustered together (e.g. in (e.g. discrete) clumps) in the micro-particle.

In a preferred embodiment, when the micro-particle comprises a plurality of nano-wires, the plurality of nano-wires are oriented in same direction (i.e. aligned with each other) in the micro-particle. This helps to increase the overall magnetic dipole of the magnetic micro-particle and thus the torque that is generated to manipulate the micro-particle in a (e.g. oscillating) magnetic field. As will be appreciated, a micro-particle containing aligned magnetic nano-wires has a particularly enhanced magnetic dipole and thus the rotation of the micro-particle in an applied magnetic field is particularly enhanced owing to the large torque generated by the aligned nano-wires in the magnetic field. When the micro-particle has an ellipsoid (e.g. spheroid) shape, preferably the magnetic nano-wires are aligned with the major axis of the ellipsoid.

The one or more nano-wires may be made from any suitable and desired (magnetic) material. In one embodiment the one or more nano-wires are paramagnetic. In a preferred embodiment the one or more nano-wires are superparamagnetic. Superparamagnetic nano-wires (and thus superparamagnetic micro-particles) provide a fast response for the magnetic micro-particles to an externally applied magnetic field (with the nano-wires in the micro-particles aligning with the magnetic field, e.g. the micro-particles rotate such that the nano-wires therein align). The superparamagnetism of the micro-particles also means that the micro-particles have negligible remanence (residual magnetism) when a magnetic field is removed (i.e. the nano-wires relax when the magnetic field is removed). These properties help to allow the magnetism of the magnetic micro-particles (and thus the magnetism of a material comprising the magnetic micro-particles) to be controlled relatively easily. For example, if the remanence were to be non-negligible, the micro-particles may clump together when the external magnetic field is removed, which is undesirable.

In a preferred embodiment the nano-wires comprise (are made from) magnetite ($Fe_3O_4$). Magnetite is tolerated by the human body and so micro-particles containing magnetite nano-wires may be able to be used for therapeutic uses, e.g. drug delivery.

The one or more nano-wires may have any suitable and desired dimensions. Preferably the nano-wires are elongate, e.g. have a length that is greater than their width (e.g. (cylindrical) diameter). Preferably the ratio of the length of the nano-wires to the width of the nano-wires is between 2 and 50, e.g. between 2 and 10, e.g. approximately 5.

In a preferred embodiment the length of the nano-wires is between 10 nm and 100 nm, e.g. approximately 50 nm. In a preferred embodiment the width (e.g. diameter) of the nano-wires is between 2 nm and 20 nm, e.g. 10 nm.

The magnetic micro-particles of the present invention may be made in any suitable and desired way. However, the Applicant has devised a method of manufacturing micro-particles that is considered to be novel and inventive. Thus when viewed from a second aspect the invention provides a method of manufacturing magnetic micro-particles, the method comprising:

- forming an emulsion of droplets of a first solution in a second solution, wherein the first solution comprises a plurality of magnetic nano-wires; and
- recovering magnetic micro-particles comprising magnetic nano-wires formed from the droplets of the first solution from the emulsion.

Thus the present invention extends to a method of manufacturing the magnetic micro-particles. The micro-particles are formed from an emulsion of droplets of a first solution in a second solution, the first solution containing (e.g. a dispersion of) magnetic nano-wires. Thus the continuous phase of the emulsion comprises the second solution and the dispersed phase of the emulsion comprises droplets of the first solution. Once the emulsion has been formed (i.e. to form the droplets of the first solution in the second solution), magnetic micro-particles (containing magnetic nano-wires) that are formed from the droplets of the first solution can be recovered from the emulsion.

As will be appreciated by those skilled in the art, this aspects of the invention can, and preferably does, include any one or more or all of the preferred and optional features of the present invention discussed herein (e.g. of the magnetic micro-particles per se), as appropriate.

The magnetic nano-wires, which the first solution contains, may be ready made, however preferably the method comprises forming a plurality of nano-wires.

The magnetic (e.g. magnetite) nano-wires may be formed in any suitable and desired way. Preferably the magnetic nano-wires are formed by a hydrolysis reaction of iron (e.g. $Fe^{3+}$ and/or $Fe^{2+}$). Preferably the hydrolysis reaction comprises a reflux reaction.

In a preferred embodiment the step of forming the magnetic nano-wires comprises preparing a solution of an iron precursor (e.g. two iron precursors). Preferably the solution comprises water as a solvent. Preferably the iron precursor comprises iron(III) chloride ($FeCl_3$) and/or iron(II) sulphate ($FeSO_4$). The iron precursor(s) may be provided in any suitable and desired concentration, e.g. 420 mM of iron(III) chloride in 4 M of water and/or 210 mM of iron(II) sulphate in 7 M water.

Preferably the solution also comprises urea ($CO(NH_2)_2$) (e.g. 1 M), e.g. prepared with purified or deoxygenated water. Urea helps to precipitate the, e.g. magnetite, nano-wires from the iron precursor solution, through decomposition of the urea in the solution.

Preferably the solution comprising the iron precursor(s) is heated (e.g. to a temperature of between 90 and 100 degrees centigrade) and then cooled. In a preferred embodiment the step of forming the magnetic nano-wires comprises precipitating the nano-wires from the solution. Preferably the solvent (e.g. water) is evaporated (and preferably then condensed back into solution, i.e. a reflux reaction) to allow the nano-wires to precipitate. Preferably the nano-wires are formed (e.g. precipitated) over a period of approximately 12 hours, e.g. over which time the solution is heated, evaporated and re-condensed.

Preferably the (precipitated) nano-wires are washed (e.g. using purified, deoxygenated water) and then preferably dried, e.g. at a temperature of approximately 40 degrees centigrade over, e.g., a period of approximately ten hours. Preferably the nano-wires are magnetically decanted (e.g. after being washed and, e.g., before being dried).

In a preferred embodiment the method comprises the step of dispersing a plurality of magnetic nano-wires in the first solution (e.g. before the emulsion is formed). Thus preferably once this mixture of the first solution containing the magnetic nano-wires has been formed, the emulsion of the first solution and the second solution may then be formed.

The magnetic nano-wires may be dispersed in the first solution in any suitable and desired way. In a preferred embodiment the method comprises sonicating the first solution (e.g. using ultrasonification or a sonic bath) to disperse the nano-wires evenly throughout the first solution. The first solution may contain any suitable and desired amount of nano-wires dispersed therein, e.g. 0.05% to 2% weight-to-volume, e.g. 0.5% to 1% weight-to-volume.

The first solution may be any suitable and desired solution. In a preferred embodiment the first solution comprises an organic, e.g. non-polar, solvent. Preferably the first solution comprises dichloromethane ($CH_2Cl_2$) as a solvent.

As outlined above, preferably the magnetic micro-particles comprise a polymer, e.g. a cross-linked polymer. Therefore preferably the first solution (from which the magnetic micro-particles are formed) comprises a polymer or a polymerisable monomer (e.g. depending on whether polymerisation takes place before or after the emulsion is formed, as will be explained below).

The term polymerisable monomer is used herein to refer to the molecular building blocks from which a polymer may be produced. The term thus includes the primary monomer, as well as any branching or non-branching comonomers, or crosslinking agents. In general, however, any non-branchings/non-crosslinking monomers will preferably constitute the majority (by weight), e.g. greater than 80% weight, e.g. greater than 90% weight, e.g. greater than 95% weight, of the overall monomer.

The polymer or the polymerisable monomer in the first solution may comprise any suitable and desired polymer or polymerisable monomer. In a preferred embodiment the polymer comprises polycaprolactone ($[C_6H_{10}O_2]_n$). Similarly, in a preferred embodiment the polymerisable monomer comprises (e.g. linear) monomers of polycaprolactone ($[C_6H_{10}O_2]_n$), e.g. caprolactone ($(CH_2)_5CO_2$) (e.g. first having its cyclic structure broken). The first solution may comprise any suitable and desired concentration of the polymer or polymerisable monomer, e.g. 0.5 mM.

Preferably the first solution comprises a cross-linking initiator, e.g. benzoyl peroxide ($(C_6H_5CO)_2O_2$). The first solution may comprise any suitable and desired concentration of the cross-linking initiator (e.g. benzoyl peroxide), e.g. 2.5% by volume. When the first solution comprises a polymerisable monomer, preferably the first solution comprises a polymerisation initiator.

The second solution (in which droplets of the first solution are formed) may comprise any suitable and desired solution. In a preferred embodiment the second solution comprises a polar solvent. Preferably the second solution comprises an aqueous solution, e.g. with water as a solvent.

Thus preferably the first solution and the second solution are immiscible, e.g. so that the emulsion is stable. Preferably the emulsion comprises an oil-in-water emulsion.

Preferably the second solution comprises a stabiliser for the droplets of the first solution, e.g. a non-surfactant stabiliser. This helps to maintain the emulsion of the first solution in the second solution. Preferably the stabiliser comprises polyvinyl alcohol ($[CH_2CH(OH)]_n$). The second solution may comprise any suitable and desired concentration of the stabiliser (e.g. polyvinyl alcohol), e.g. 1.5% weight-to-volume.

The droplets of the first solution may be emulsified in the second solution in any suitable and desired way. In a preferred embodiment the ratio of the first solution to the second solution (to create the emulsion) is 1:10.

Preferably the step of forming the emulsion of droplets of the first solution in the second solution comprises shaking the (e.g. mixture of the) first solution and the second solution (e.g. at approximately 3,000 rpm for approximately 10 minutes). It will be appreciated that the speed at which the mixture of the first solution and the second solution are shaken may be chosen depending on the size of droplets of the first solution (and therefore the size of the micro-particles) that are desired to be produced.

In a preferred embodiment the method further comprises adding a gelling agent (e.g. phosphate-buffered agar) to the second solution to set the emulsion. This helps to set the second solution to immobilise the droplets of the first solution in the second solution, e.g. so that the magnetic nano-wires may then be aligned, and, e.g., so that the droplets may then be polymerised (both of which will be described below). Preferably the step of adding the gelling agent follows (e.g. immediately) the step of emulsifying the first and second solutions but, e.g., before the droplets of the first solution are polymerised. The gelling agent may be added to the second solution in any suitable and desired concentration, e.g. 1%.

Preferably the method comprises cooling the emulsion, e.g. after the gelling agent has been added to the emulsion. This helps the gelling agent to act to set the emulsion. The emulsion may be cooled by placing it in a freezer, e.g. for 10 minutes.

In a preferred embodiment the method comprises applying a static magnetic field to the emulsion (e.g. after the emulsion is created, e.g. after the gelling agent has been added, e.g. while the second solution is setting). Applying a static magnetic field to the emulsion helps to orient the nano-wires in (e.g. each of) the droplets of the first solution in the same direction as each other (or at least clump the nano-wires together), e.g. when there are multiple nano-wires in each droplet. The magnetic field also helps to stretch the droplets of the first solution from spheres into spheroids.

The magnetic micro-particles may be formed from the droplets of the first solution in any suitable and desired way. In one embodiment, when the first solution comprises a polymer, the polymer is preferably ready-made, e.g. polymerised previously. Thus the emulsion is formed from the first (polymer) solution to form the droplets of the first solution, and then once the droplets of the first solution have been formed, the micro-particles formed from the droplets can be recovered from the emulsion, e.g. after the droplets are hardened (e.g. owing to cross-linking of the polymer). Thus preferably the method comprises the step of hardening (e.g. cross-linking the polymer in) the droplets to form the micro-particles. This helps to immobilise the, e.g. aligned, nano-wires in the micro-particles.

In another embodiment the first solution comprises a polymerisable monomer. Preferably the polymerisable monomer is polymerised in situ, i.e. in the emulsion, to form the magnetic micro-particles. Thus preferably the method comprises the step of polymerising the polymerisable monomer in the droplets of the first solution, e.g. after the emulsion (and thus the droplets of the first solution) has been formed. Preferably then the method also comprises the step of hardening (e.g. cross-linking the polymer in) the droplets to form the micro-particles.

The droplets of the first solution may be polymerised and/or cross-linked in any suitable and desired way, e.g. to produce (e.g. cross-linked) polymer micro-particles within the emulsion. This allows the droplets to polymerise and/or cross-link (harden), therefore fixing the position of the nano-wires in the droplets. As the first solution preferably comprises a polymerisation initiator and/or a cross-linking initiator, preferably the method comprises allowing the droplets of the first solution (in the (e.g. set) emulsion of the first solution and the second solution) to polymerise and/or cross-link (harden) over a period of time (e.g. more than 4 hours, e.g. more than 6 hours, e.g. more than 8 hours). Preferably the droplets of the first solution are polymerised and/or cross-linked (hardened) at room temperature, e.g. approximately 20 degrees centigrade.

Preferably the static magnetic field is applied while the droplets in the emulsion are being polymerised and/or cross-linked (hardened). This helps to ensure that when there are multiple nano-wires in each droplet, all the multiple nano-wires in a droplet are oriented and immobilised in the same direction once the droplet has been polymerised and/or cross-linked (hardened), and that the droplet retains a spheroid shape. The static magnetic field applied may have any suitable and desired strength, preferably between 1 mT and 5 T, e.g. between 10 mT and 2 T, e.g. between 100 mT and 1 T, e.g. approximately 400 mT. In some embodiments the static magnetic field applied may have a strength greater than 1 T. This may be necessary to align the plurality of nano-wires in a droplet in the same direction. Below this magnetic field strength clusters of nano-wires may form.

The magnetic micro-particles formed from the droplets of the first solution may be recovered from the emulsion in any suitable and desired way, e.g. by removing the continuous phase of the emulsion (formed from the second solution). In a preferred embodiment the method comprises applying a magnetic field to the emulsion to attract the magnetic micro-particles out of the second solution. When the emulsion has been set by a gelling agent, preferably the method comprises melting the (e.g. continuous phase of the) emulsion. Melting the set emulsion allows the polymerised (and, e.g., cross-linked) droplets in the emulsion to be mobilised (e.g. under the influence of a magnetic field) so that they may then be recovered from the emulsion.

The magnetic micro-particles of the present invention may be used for any suitable and desired application. For example, the magnetic micro-particles may be used for one or more of: in biomedicine: for drug delivery, cell therapy, cell isolation and/or (e.g. modular) tissue engineering; magnetic tweezers; magnetic micro-mixing of fluids; magnetic flow cytometry; in single cell or bacteria studies: fluorescence, magnetic enzyme-linked immunosorbent assays (ELISAs), and/or cell labelling and/or imaging; isolation and/or purification of biological material (e.g. nucleic acids, antibodies and/or other proteins).

A number of embodiments of the invention will now be described, by way of example only, with reference to the accompanying drawings, in which.

Magnetic micro-particles, e.g. containing magnetic nano-particles, can be used to manipulate small volumes of fluid and other material in a variety of ways and for a variety of uses. For example, there are a number of chemical and biomedical uses in which magnetic micro-particles can be used (under the influence of an applied magnetic field) for micro-mixing of liquids, in flow cytometry, for single cell studies, as magnetic tweezers, etc.

Figure 1:
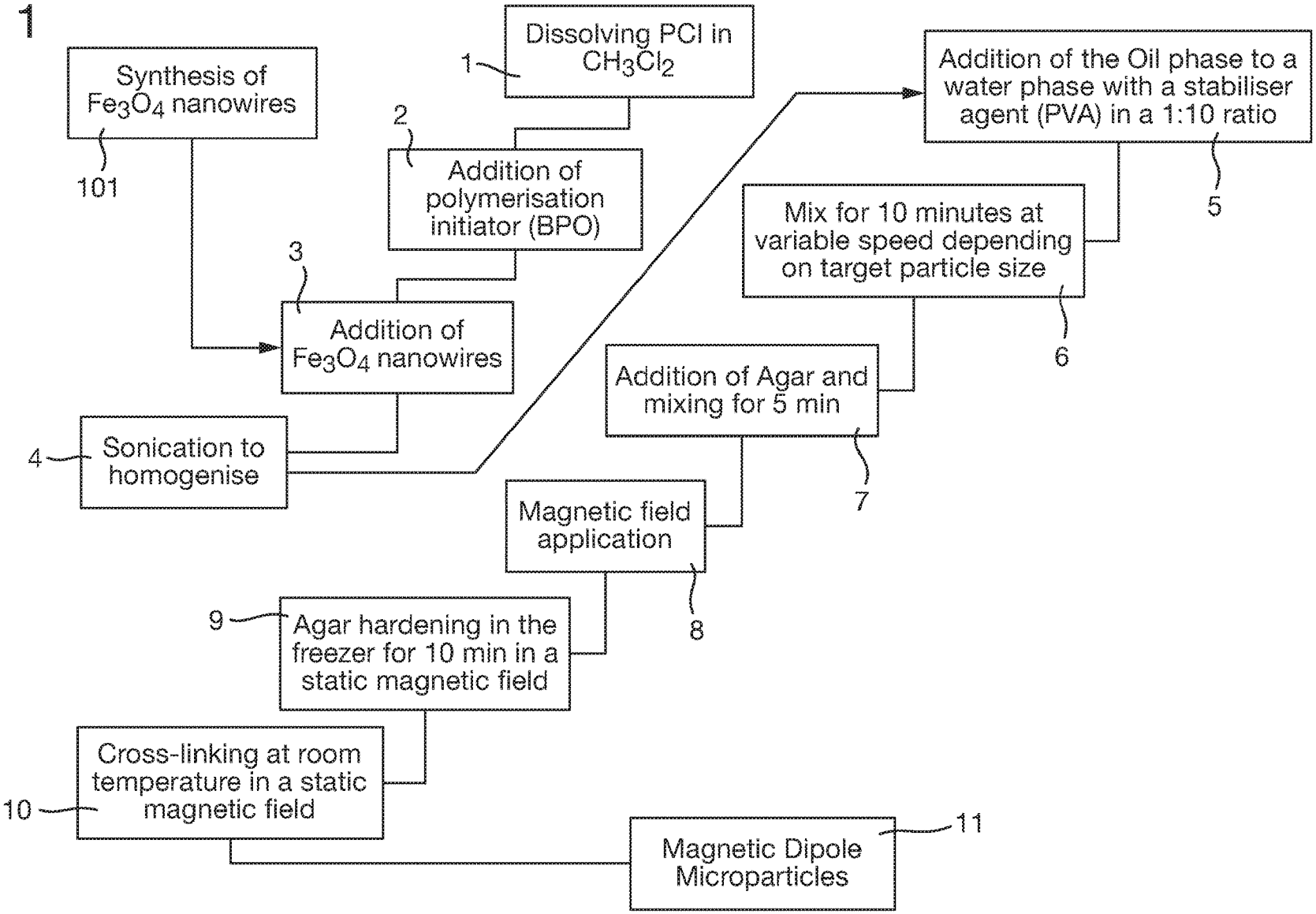
FIG. 1 shows a flow chart detailing the steps of a method of manufacturing magnetic micro-particles according to an embodiment of the invention.

FIG. 1 shows a flow chart detailing the steps of a method of manufacturing magnetic micro-particles according to an embodiment of the invention.

In order to make the magnetic nano-wires for the micro-particles, magnetite ($Fe_3O_4$) nano-wires are synthesised (step 101, FIG. 1) in a hydrolysis reflux reaction of iron(III) ($Fe^{3+}$) using two iron precursors: iron(III) chloride ($FeCl_3$) and iron(II) sulphate ($FeSO_4$). A solution of the iron precursors containing 420 mM of iron(III) chloride (e.g. in 4M water), 210 mM of iron(II) sulphate (e.g. in 7 M water), and 1 M urea ($CO(NH_2)_2$) is prepared with deoxygenated Milli-Q water and stirred for 10 minutes.

The solution is then added to a round flask with a reflux condenser which is immersed in an oil bath at 90-100 degrees centigrade. When the solution has reached thermal equilibrium with the oil bath the solution is then removed from the oil bath and cooled to room temperature and aged for twelve hours, in which time the water evaporates from the solution and nano-wires precipitate from the solution. The nano-wires produced are then washed four times with purified, deoxygenated water, magnetically decanted and dried at 40 degrees centigrade over a period of ten hours.

In order to make the micro-particles, a first (polymer) solution is made, along with a second (aqueous) solution, to create an emulsion of droplets of the polymer solution in the aqueous solution.

To make the polymer solution, 0.05 mM of unlinked chains of polycaprolactone ($[C_6H_{10}O_2]_n$) is dissolved in dichloromethane ($CH_2Cl_2$) to form a solution (step 1, FIG. 1). Benzoyl peroxide ($(C_6H_5CO)_2O_2$) (BPO) is added to this solution as a cross-linking initiator at a concentration of 2.5% by volume (step 2, FIG. 1).

The previously formed nano-wires are then added to the solution (step 3, FIG. 1) at a concentration of 1% weight-to-volume. The solution containing the nano-wires is then sonicated using ultrasonification to disperse the nano-wires evenly throughout the solution (step 4, FIG. 1).

To make the aqueous solution, polyvinyl alcohol ($[CH_2CH(OH)]_n$) is added in a 1.5% weight-to-volume concentration to water to act as a non-surfactant stabiliser for the droplets of the polymer solution to be added to the aqueous solution. The polymer solution ("oil phase") is then added to the aqueous solution ("water phase") in a 1:10 ratio (step 5, FIG. 1).

To emulsify the polymer solution into droplets in the aqueous solution, the mixture is shaken at 3,000 rpm for 10 minutes (step 6, FIG. 1). Immediately after this shaking, phosphate-buffered agar at a concentration of 1% is added as a gelling agent to the emulsion and mixed for 5 minutes (step 7, FIG. 1).

As the emulsion is setting under the action of the phosphate-buffered agar, a static magnetic field of 0.4 T is applied to the emulsion (step 8, FIG. 1). The magnetic field acts to cluster the magnetic nano-wires in the droplets of the polymer solution. (Applying a magnetic field of greater than 1 T acts to align the magnetic nano-wires in the droplets of the polymer solution, so that the magnetic nano-wires in each droplet are oriented in the same direction.)

With the magnetic field still applied, the emulsion is hardened in a freezer for ten minutes (step 9, FIG. 1). This immobilises the droplets of the polymer solution so that they can then be cross-linked. Over a period of ten hours at room temperature, and with the magnetic field still being applied, the droplets of the polymer solution are cross-linked (hardened) (step 10, FIG. 1). Applying the magnetic field over this period of time helps to ensure that the magnetic nano-wires in each polymerised and cross-linked micro-particle are oriented in the same direction.

Once the droplets of the polymer solution have hardened (cross-linked) into micro-particles, the set emulsion is heated in a water bath to melt the phosphate-buffered agar. The magnetic micro-particles can then be attracted out of the melted emulsion by applying a magnetic field to obtain the magnetic micro-particles (step 11, FIG. 1).

Figure 2:
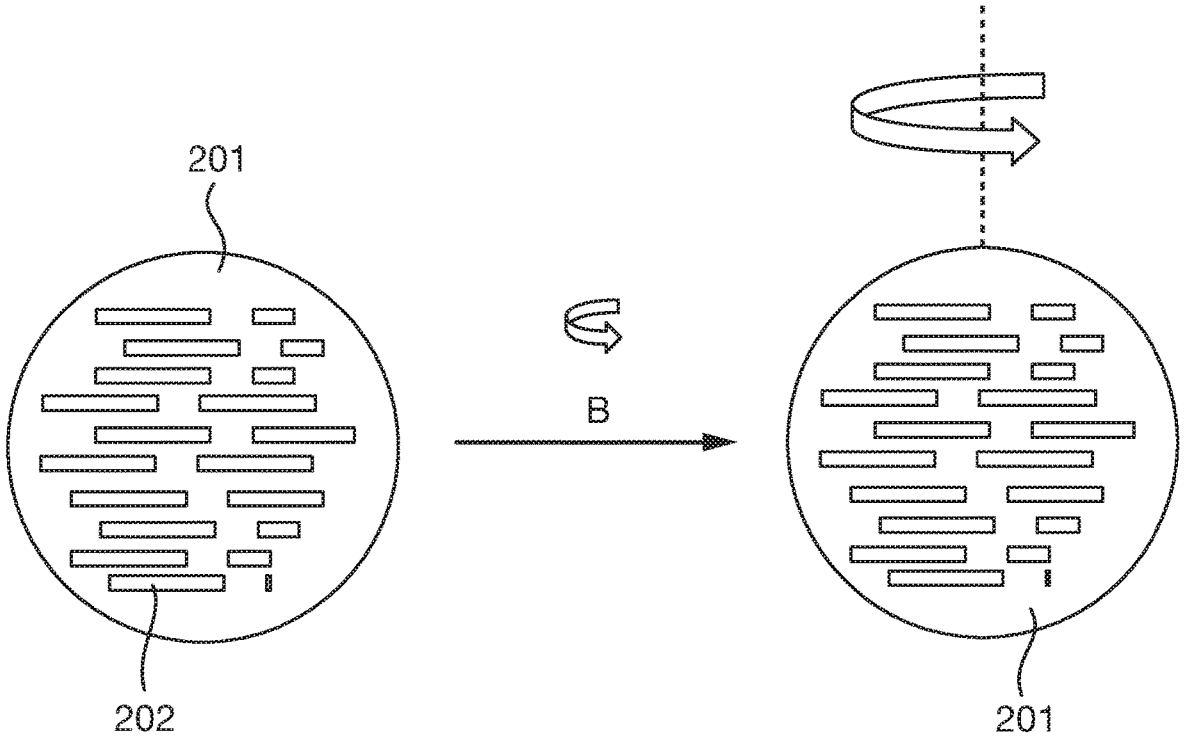
FIG. 2 shows a schematic of a magnetic micro-particle according to an embodiment of the invention.

FIG. 2 shows a schematic of a magnetic micro-particle 201 according to an embodiment of the invention. The cross-linked polymer micro-particle 201 contains a plurality of superparamagnetic nano-wires 202 that are suspended within the micro-particle 201 and oriented in the same direction. Each nano-wire 202 forms a magnetic dipole, such that the magnetic dipoles plurality of nano-wires 202 sum to give the micro-particle 201 an overall magnetic dipole.

Thus, when a magnetic field is applied to the magnetic micro-particle 201, the magnetic field acts on the magnetic dipole of the magnetic micro-particle 201 and causes the superparamagnetic micro-particle 201 to move in the magnetic field. This allows the magnetic micro-particle 201 to be manipulated under the influence of a magnetic field.

As shown in FIG. 2, a rotating magnetic (B) field causes the magnetic micro-particle 201 to rotate. Owing to the superparamagnetism of the micro-particle 201, it respond quickly to the externally applied magnetic field (with the nano-wires in the micro-particle 201 aligning with the magnetic field, e.g. the micro-particle 201 rotates such that the nano-wires therein align with the magnetic field). When the magnetic field is removed, the superparamagnetic nano-wires in the micro-particle 201 relaxes and thus the micro-particle 201 has negligible remanence (residual magnetism) when the magnetic field is removed.

As will be appreciated, a micro-particle or a plurality of micro-particles that are able to be manipulated in this way can be used for a variety of different uses, e.g. for one or more of: in biomedicine: for drug delivery, cell therapy, cell isolation and/or (e.g. modular) tissue engineering; magnetic tweezers; magnetic micro-mixing of fluids; magnetic flow cytometry; in single cell or bacteria studies: fluorescence, magnetic enzyme-linked immunosorbent assays (ELISAs), and/or cell labelling and/or imaging; isolation and/or purification of biological material (e.g. nucleic acids, antibodies and/or other proteins).

Figure 3:
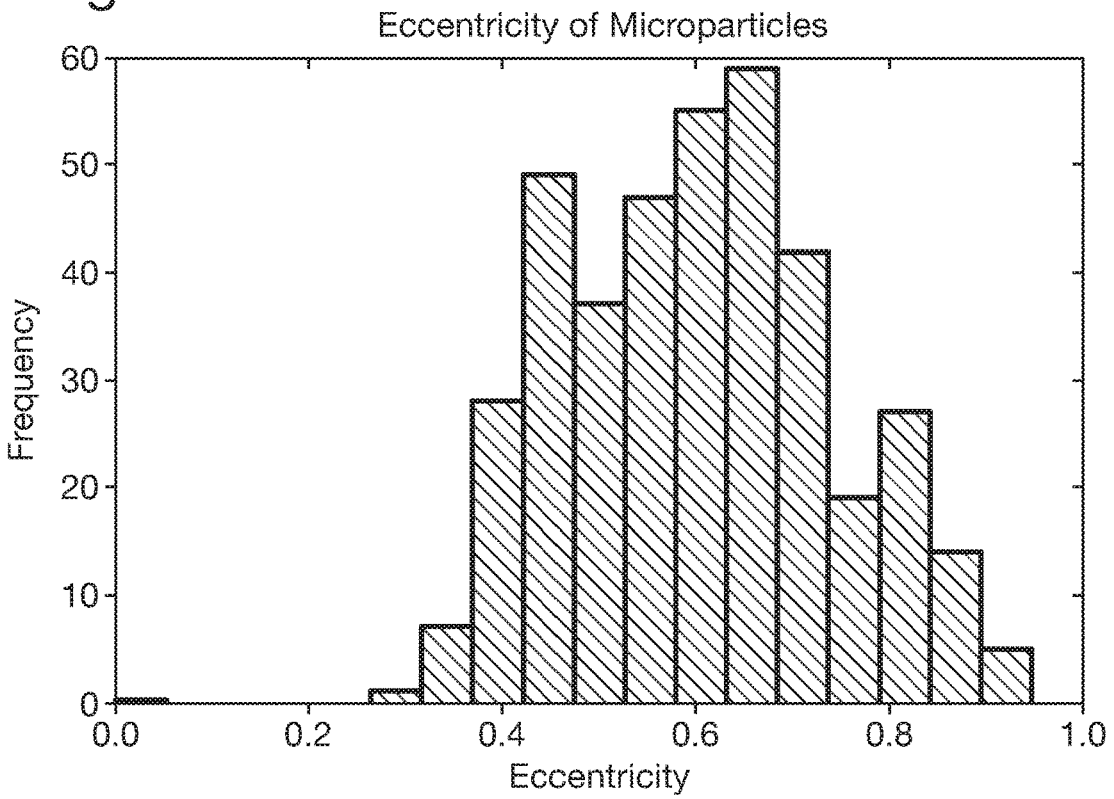
FIG. 3 shows a graph of the distribution of the eccentricity of micro-particles made according to an embodiment invention.

FIG. 3 shows a graph of the distribution of the eccentricity of micro-particles made according to an embodiment of the method outlined above with reference to FIG. 1.

In one set of embodiments, the application of the magnetic field to the polymer droplets, as outlined above, in addition to causing the nano-wires to clump together or align in a particular direction, is arranged to stretch out the polymer droplets to form a spheroid shape. The eccentricity, $$\varepsilon = \sqrt{\frac{a^2 - b^2}{a^2}}$$

(where a and b are the respective lengths of the major and minor axes of the spheroid, assuming that the two equatorial axes of the spheroid are of approximately equal length), of micro-particles made according to the method outlined above with reference to FIG. 1, is shown in FIG. 3. This shows that the eccentricity of these micro-particles is between 0.3 and 0.95, with a modal value of approximately 0.65.

Figure 4:
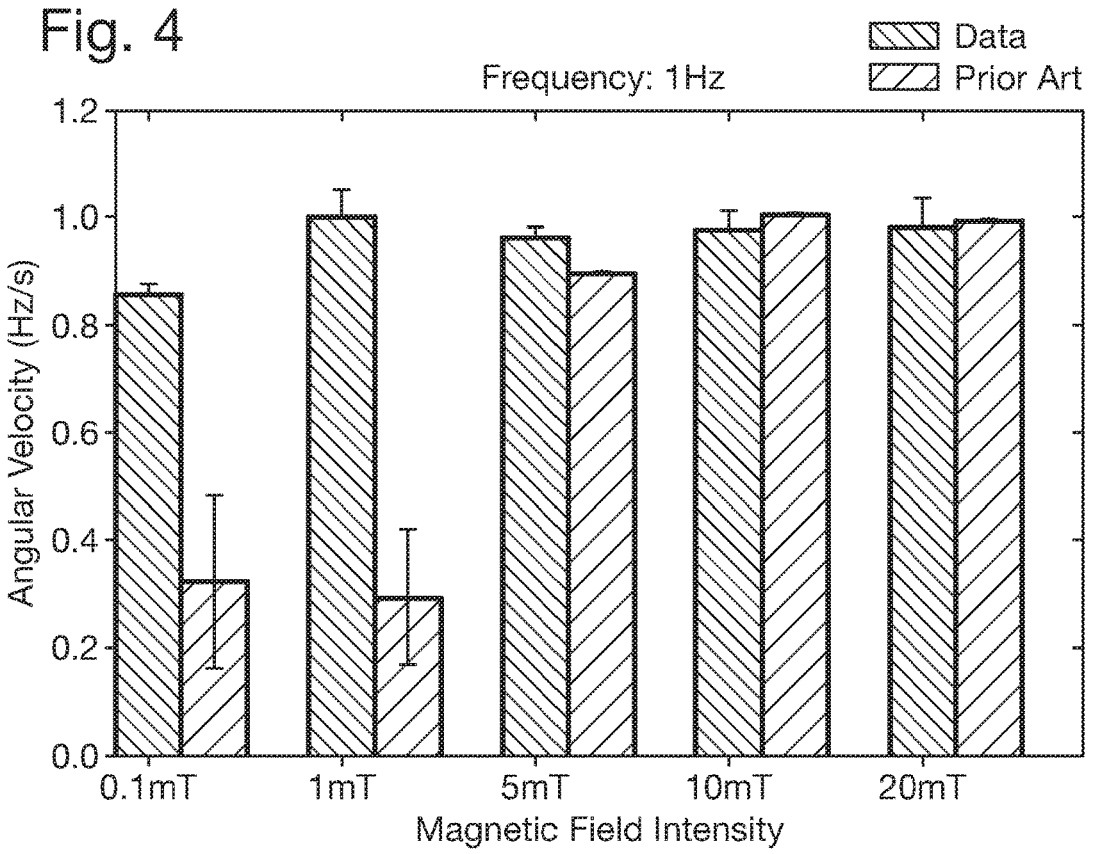
FIG. 4 shows a graph of the angular velocity against magnetic field intensity of ellipsoid magnetic micro-particles made according to an embodiment of the present invention.

FIG. 4 shows a graph of the angular velocity against magnetic field intensity of ellipsoid magnetic micro-particles made according to an embodiment of the present invention.

The ellipsoid magnetic micro-particles made according to an embodiment of the present invention, e.g. as outlined above with reference to FIG. 1, were placed in an oscillating magnetic field having a frequency of 1 Hz. The intensity of the magnetic field was varied between 0.1 mT and 20 mT, and the angular velocity of the magnetic micro-particles was measured (the "Data" shown in FIG. 4). The same measurement was performed for spherical magnetic micro-particles having magnetic nano-particles inside them (the "Prior art" shown in FIG. 4).

Figure 5:
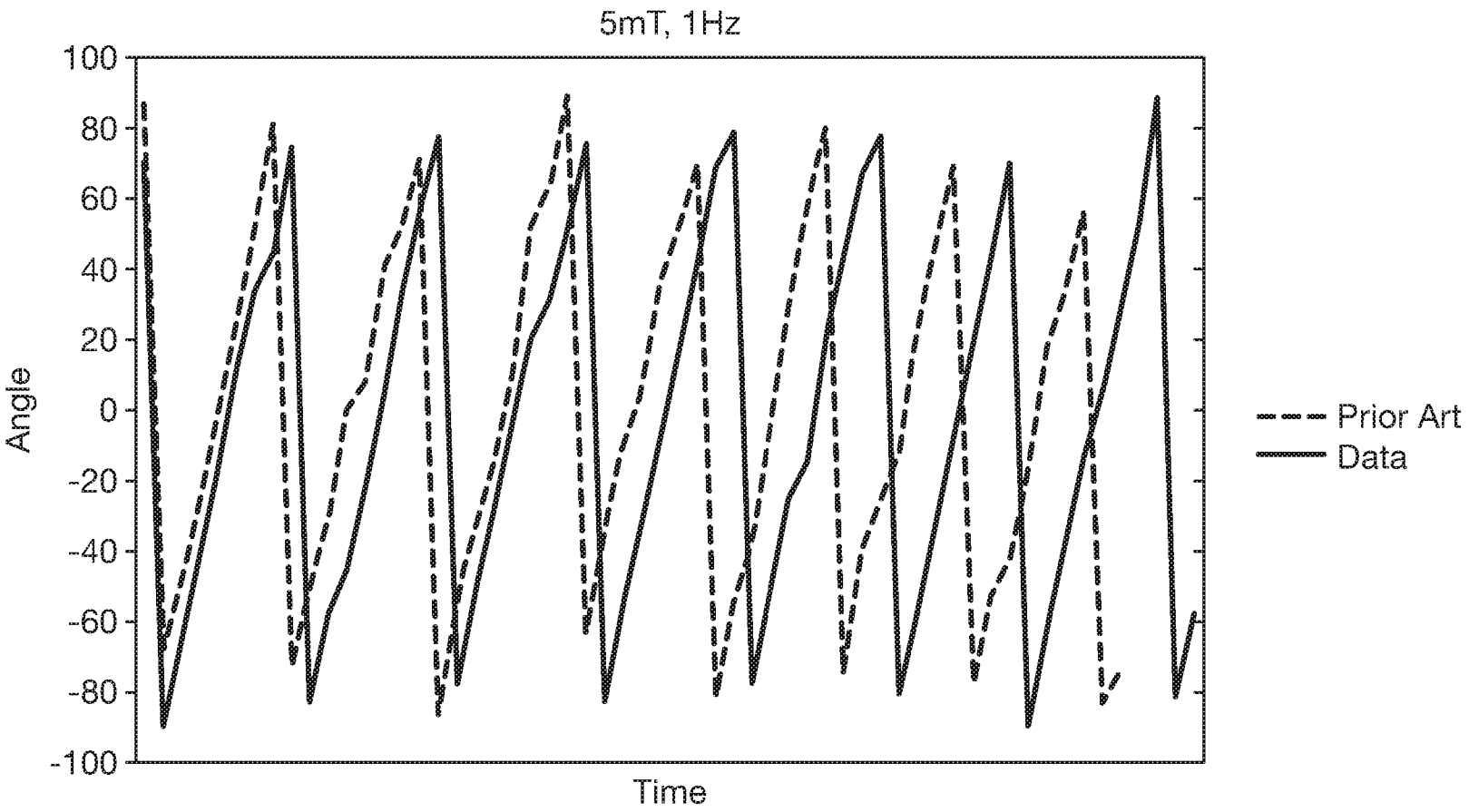
FIG. 5 shows a graph of the angle of rotation of the magnetic micro-particles shown in FIG. 4.

FIG. 5 shows a graph of the angle of rotation of the magnetic micro-particles shown in FIG. 4, with a magnetic field strength of 5 mT.

FIGS. 4 and 5 show that the ellipsoid magnetic micro-particles made according to an embodiment of the present invention follow the magnetic field applied to the magnetic micro-particles, even at low field strengths, while the spherical magnetic micro-particles having magnetic nano-particles inside them lag behind the magnetic field, particularly at low field strengths. The magnetic micro-particles made according to an embodiment of the present invention thus have a higher angular velocity, again particularly at low field strengths.

It will be seen from the above embodiment micro-particles containing magnetic nano-wires can be made that have a relatively significant magnetic dipole, owing to the length of the nano-wires and their alignment in each micro-particle. This allows a relatively large torque to be exerted on each of the micro-particles, e.g. when an oscillating magnetic field is applied to the micro-particles. This may be used, when a magnetic field is applied, to rotate the magnetic micro-particles in a fluid containing the micro-particles.

This contrasts to conventional micro-particles containing point magnetic nano-particles which have no length over which to form a meaningful magnetic dipole. Such conventional magnetic micro-particles have non-homogeneous magnetic properties which are difficult to control, particularly for rotating. The presence of nano-wires in the micro-particles of embodiments of the present invention therefore allows the micro-particles to be controlled more easily and to be moved, e.g. rotated, more quickly than micro-particles that simply contain magnetic nano-particles.

The skilled person will appreciate that the embodiment described above is a preferred implementations and thus a magnetic micro-particle or method of manufacturing a magnetic micro-particle as defined by the scope of the claims may not have all of the features described for these embodiments. For example, the mixture of the polymer solution and the aqueous solution may be mixed at any suitable and desired speed to form the emulsion in order to determine the size of the droplets of the polymer solution (and thus the size of the magnetic micro-particles), as micro-particles of a number of different sizes may be required depending on the end application for the micro-particles.

The invention claimed is:

1. A magnetic micro-particle comprising one or more magnetic nano-wires, wherein the micro-particle is an ellipsoid having an eccentricity between 0.3 and 1; and wherein the one or more nano-wires have a length between 10 nm and 100 nm; and wherein a maximum dimension of the micro-particle is between 1 μm and 1 mm.

2. The magnetic micro-particle as claimed in claim 1, wherein the micro-particle comprises a polymer.

3. The magnetic micro-particle as claimed in claim 1, wherein the magnetic nano-wires are immobilised within the micro-particle.

4. A magnetic micro-particle comprising a plurality of magnetic nano-wires, wherein the micro-particle is an ellipsoid having an eccentricity between 0.3 and 1; and wherein the plurality of nano-wires have a length between 10 nm and 100 nm.

5. The magnetic micro-particle as claimed in claim 4, wherein the plurality of nano-wires are clumped together or oriented in same direction.

6. The magnetic micro-particle as claimed in claim 1, wherein the one or more nano-wires are superparamagnetic.

7. A magnetic micro-particle comprising one or more magnetic nano-wires, wherein the micro-particle is an ellipsoid having an eccentricity between 0.3 and 1;

wherein the one or more nano-wires have a length between 10 nm and 100 nm; and wherein the one or more nano-wires comprise magnetite.

8. The magnetic micro-particle as claimed in claim 1, wherein the one or more nano-wires have a ratio of a length to a width of between 2 and 10.

9. A magnetic micro-particle comprising one or more magnetic nano-wires, wherein the micro-particle is an ellipsoid having an eccentricity between 0.3 and 1;

wherein the one or more nano-wires have a length between 10 nm and 100 nm;

wherein the micro-particle comprises a polymer; and wherein the polymer is polycaprolactone.

10. The magnetic micro-particle as claimed in claim 1, wherein a maximum dimension of the micro-particle is between 10 μm and 300 μm.

11. The magnetic micro-particle as claimed in claim 1, wherein a maximum dimension of the micro-particle is between 50 μm and 100 μm.

12. The magnetic micro-particle as claimed in claim 1, wherein the one or more nano-wires have a length of approximately 50 nm.

13. The magnetic micro-particle as claimed in claim 1, wherein the one or more nano-wires have a ratio of a length to a width of approximately 5.

* * * * *